US008082682B2

(12) United States Patent
Karl et al.

(10) Patent No.: US 8,082,682 B2
(45) Date of Patent: Dec. 27, 2011

(54) INSOLE FOR A BALLET SLIPPER

(75) Inventors: Margaret Karl, San Francisco, CA (US); Garen P. Scribner, San Francisco, CA (US)

(73) Assignee: Margaret Karl, San Francisco, CA (US)

( * ) Notice: Subject to any disclaimer, the term of this patent is extended or adjusted under 35 U.S.C. 154(b) by 497 days.

(21) Appl. No.: 12/322,058

(22) Filed: Jan. 29, 2009

(65) Prior Publication Data

US 2010/0186257 A1 Jul. 29, 2010

(51) Int. Cl.
*A43B 5/12* (2006.01)

(52) U.S. Cl. ..... 36/8.3; 36/44; 36/43

(58) Field of Classification Search ..... 36/8.3, 36/43, 44, 107, 76 R, 76 C
See application file for complete search history.

(56) References Cited

U.S. PATENT DOCUMENTS 2,440,705 A * 5/1948 Supple ..... 36/30 R
4,476,638 A * 10/1984 Quacquarini et al. ..... 36/86
4,628,936 A * 12/1986 Langer et al. ..... 36/173
4,654,915 A * 4/1987 Rigon ..... 12/146 B
4,718,179 A * 1/1988 Brown ..... 36/44
5,901,468 A * 5/1999 Whyte ..... 36/71
7,908,768 B2 * 3/2011 Cheskin et al. ..... 36/44
2004/0078998 A1 * 4/2004 Davis et al. ..... 36/44
2005/0066544 A1 * 3/2005 Beak ..... 36/43
2006/0143945 A1 * 7/2006 Walker ..... 36/8.3

* cited by examiner

*Primary Examiner* — Marie Patterson

(57) ABSTRACT

A point shoe insole for a ballet slipper with a two layered co-molded plastic sheet having a top layer made of semi-rigid plastic and a bottom layer made of four of rigid plastic members. The top sheet has a plurality of horizontally and downwardly facing ribs. The first and second downwardly facing ribs fit tightly between the first, second and third rigid plastic members of the bottom sheet. A third set downwardly facing ribs are located between the third rigid portion and the forth rigid portion. The area above the first and second downwardly facing ribs form hinges that allow the first, second and third rigid members to flex in an upward direction during the progression of movement of a user's foot between a flat plane and on pointe, but does not allow the first, second and third rigid members to flex in the opposite direction when the user's foot is on pointe.

7 Claims, 8 Drawing Sheets

INSOLE FOR A BALLET SLIPPER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of dance shoes and more specifically to an insole for a ballet slipper.

Ballet shoes that allow a dancer to dance on pointe, that is, on the tip of their toes, have been in existence for approximately two hundred years. Ballet shoes that allow a dancer to dance on pointe have a rigid box shape at the tip of the shoe that allows the dancer to dance while his or her toes are pointed downward toward the floor. The insole of a standard ballet slipper tends to be rather rigid at the front and middle portion of the shoe to help support the dancer's foot while on pointe.

Although this rigidity does help the dancer stay on point, there is a deficiency in the prior art in that novice dancers, especially children have a difficult time going from the flat position to the on pointe position without any intermediate articulation of the foot. Due to the rigid construction of the insole, no intermediate articulation is possible.

Currently, there are no ballet slippers available on the market or in the patent literature that allow a student to roll through, that is, to rise or descend through demi-pointe comfortably. Because of this, many young dancers suffer foot injuries during their attempts to dance on pointe.

BRIEF SUMMARY OF THE INVENTION

The primary object of the invention is to provide a ballet pointe shoe insole that allows a ballet dancer to practice dancing on pointe by progressing through a series of intermediate positions before achieving full pointe position.

Another object of the invention is to provide a pointe shoe sole whose sole combines the qualities of rigidity and flexibility where needed.

Another object of the invention is to provide a pointe shoe sole that is easy and economical to manufacture.

A further object of the invention is to provide a pointe shoe sole that has more durability and lasts longer than standard pointe shoes.

Yet another object of the invention is to provide a pointe shoe sole that can be used as a rehabilitation device for dancers recovering from an injury.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a point shoe insole for a ballet slipper comprising: a two layered co-molded plastic sheet having a perimeter shape that generally matches the plan view of a human foot, said plastic sheet having a top layer made of semi-rigid plastic, said plastic sheet having a bottom layer made of four of rigid plastic members, said first rigid member located at the Distal Phalanges region of the foot, said second rigid member located at the Middle Phalanges region of the foot, said third rigid member located at the midfoot region of the foot, said forth rigid member located at the heal region of the foot, said top sheet having a plurality of horizontally disposed downwardly facing ribs, said downwardly facing ribs having a thickness similar to that of the thickness of said bottom layer rigid plastic members, the first and second said downwardly facing ribs tightly fitting between said first, second and third rigid plastic members of said bottom sheet, a third plurality of said downwardly facing ribs being closely and evenly spaced from each other and and not having said rigid plastic members in between and located between said third rigid portion and said forth rigid portion of said bottom layer, said first rib located at the middle phalanges portion of the foot, said second rib located at the proximal phalanges portion of the foot, and said third plurality of ribs located at arch portion of the foot.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
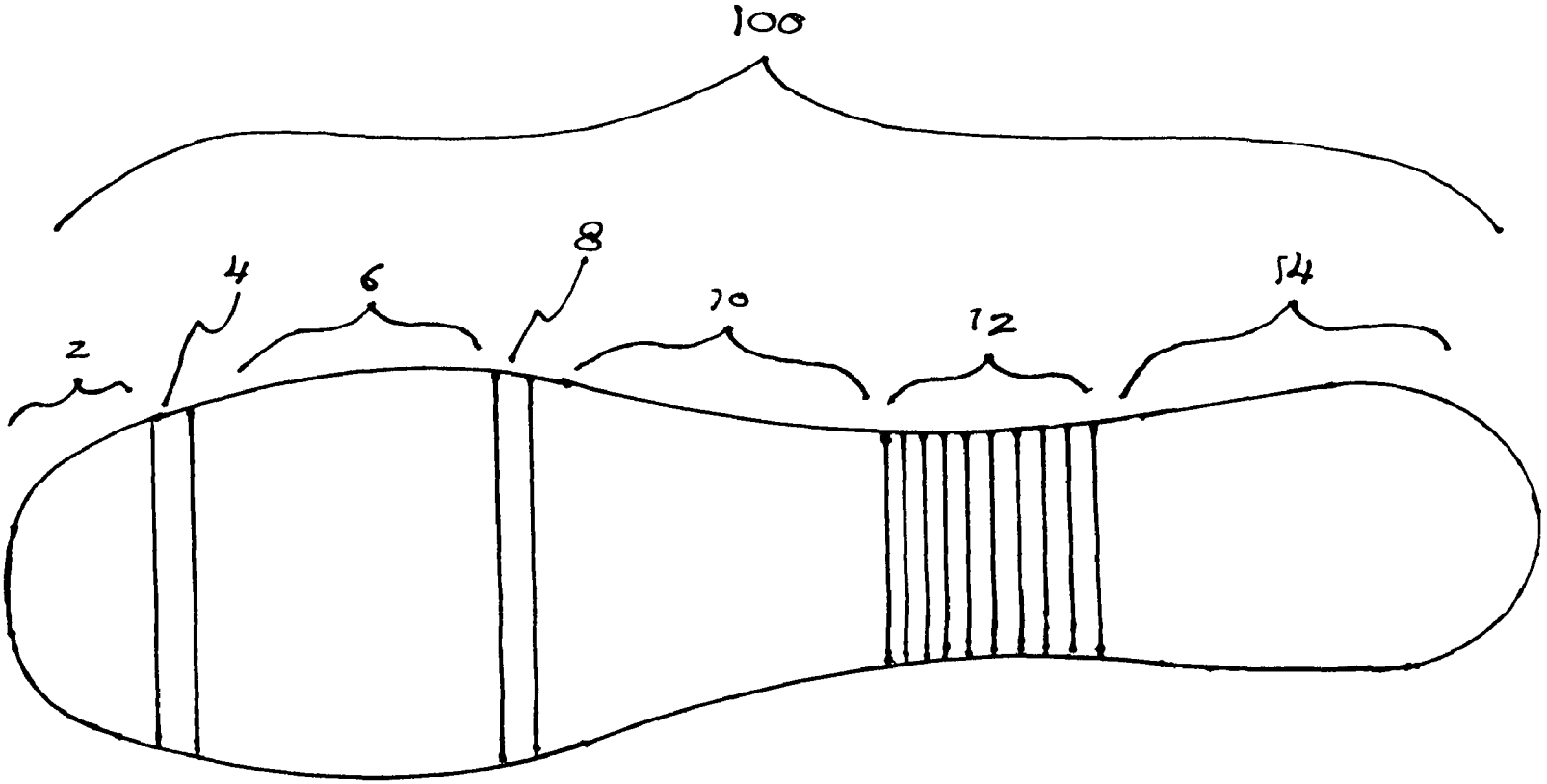
FIG. 1 is a bottom plan view of the invention.

Referring now to FIG. 1 we see a plan view of the bottom of the insole for ballet slippers of the present invention 100. The overall shape conforms generally to the perimeter of a human foot. However, it should be noted that standard ballet shoes are not specifically designed for a right foot and a left foot. This view shows the insole broken up into specific segments. Segments 2, 4, 10 and 14 are rigid in construction. First segment 2 is a rigid segment located at the Distal Phalanges region of the foot. First rib 4 is flexible and separates first rigid segment 2 from second rigid segment 4 which supports the Middle Phalanges region of the foot. Second flexible rib 8 separates the second rigid segment 6 from the third rigid segment 10. The third rigid segment supports the midfoot region of the foot. Section 12 shows a plurality of evenly spaced flexible ribs that do not have any rigid members between them. Section 12 acts as an elongated hinge that joins rigid member 10 to rigid member 14. Rigid member 14 supports the heal portion of the foot. The width of first and second ribs 4, 8 is approximately two tenths of an inch each. The first rib 4 is located at the Middle Phalanges portion of the foot. The second rib 8 is located at the Proximal Phalanges portion of the foot. The third plurality of ribs 12 is located at the arch portion of the foot.

Figure 2:
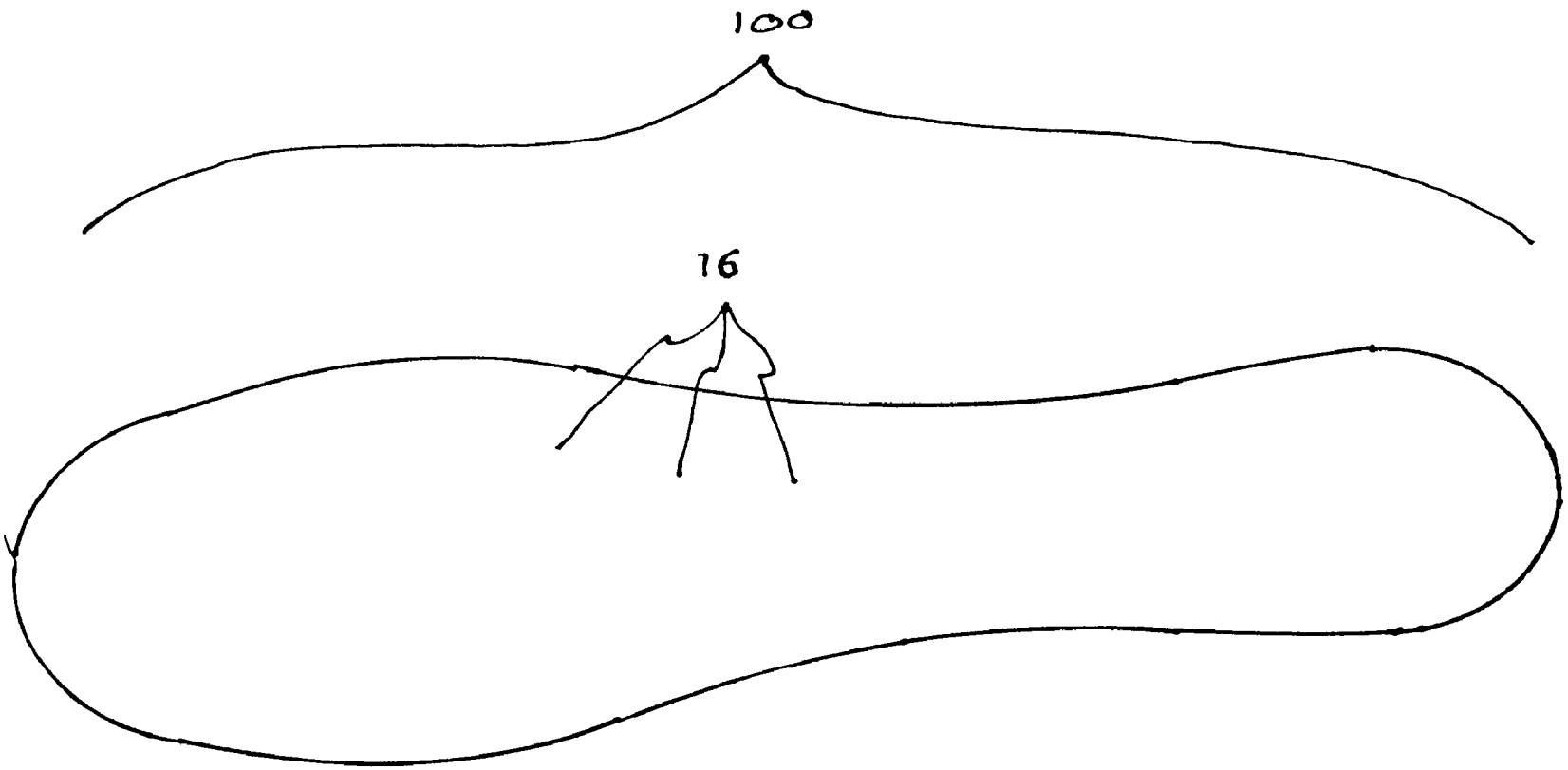
FIG. 2 is a top plan view of the invention.

FIG. 2 shows a top view of the insole of the present invention 100. The entire top portion 16 of the insole 100 is flat and undisturbed.

Figure 3:
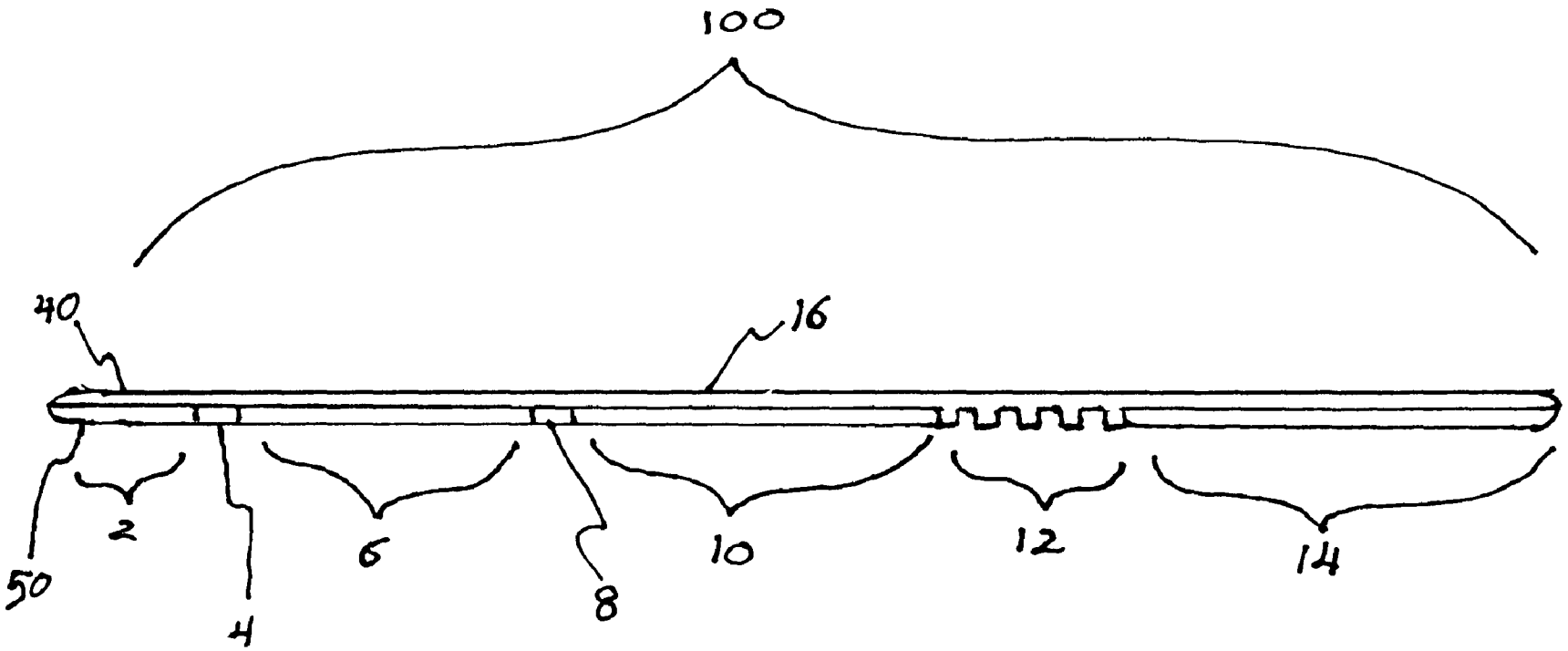
FIG. 3 is a side view of the invention in the flat position.

FIG. 3 shows a side view of the insole of the present invention 100. This view shows that the insole 100 is a sheet that is actually comprised of a top layer 40 and a bottom layer 50 that are co-molded so that they form one integral sheet. Each layer is approximately one tenth of an inch thick. Top layer 40 is molded of flexible elastomeric plastic that has a hardness rating of approximately 65 shore, such as Versaflex OM6160-9 manufactured by GLS Corporation. Bottom layer 50 is made of rigid material such as high impact ABS or other relatively rigid plastic. The relatively recent advances in co-molding allow the insole of the present invention 100 to be made economically. Because the two layers are totally fused together, they form a durable, long lasting component that can replace traditional insoles that have been made from cardboard and leather that can easily deteriorate and not perform their intended functions.

Ribs 4 and 8 extend down to the bottom of lower layer 50. The sides of these ribs 4, 8 are in very close proximity to the sides of rigid panels 2, 6 and 10 but they are not fused to the sides of the rigid panels 2, 6, 10. This configuration allows the flexible area of top layer 40 that is located just above ribs 4 and 8 to act as hinges that let rigid members 2, 6, 10 to flex upward, but not to flex downward.

Figure 4:
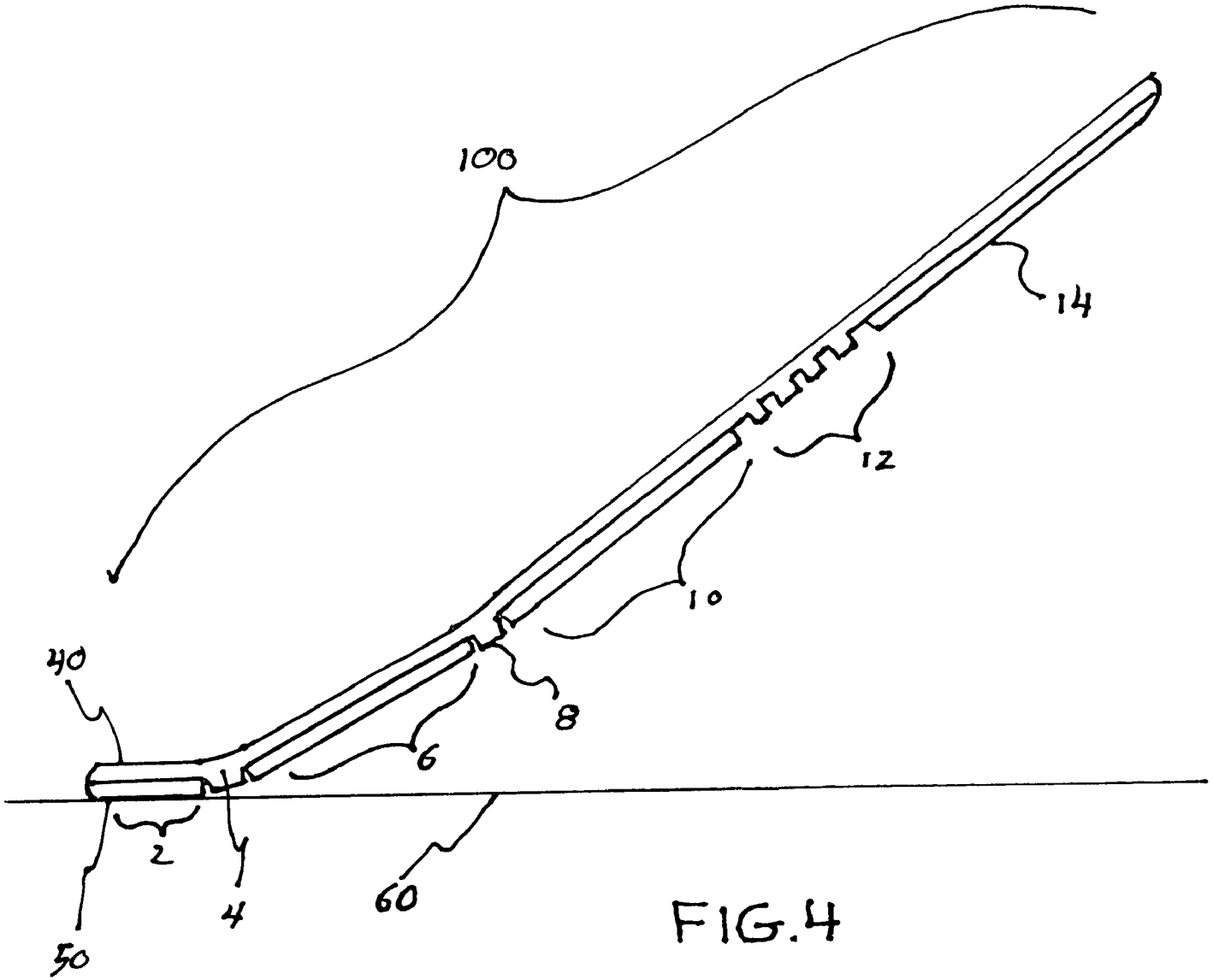
FIG. 4 is a side view of the invention in the one third rise position.
Figure 5:
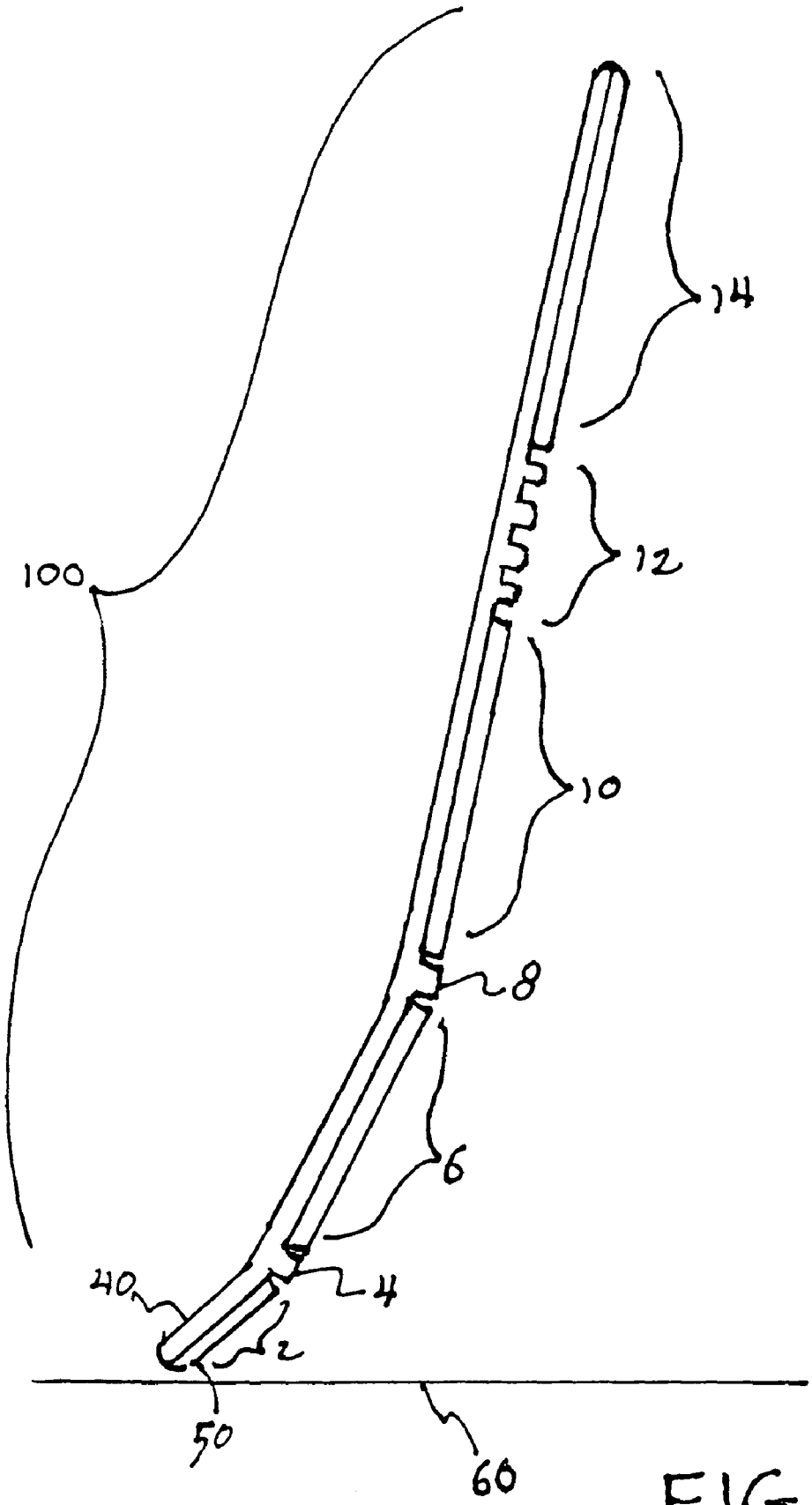
FIG. 5 is a side view of the invention in the two thirds rise position.

FIGS. 4 and 5 show the insole of the present invention 10 in a one third and two thirds intermediate position that would be found when a person wearing a ballet slipper with the insole of the present invention is in the process of going from a flat plane 60 to a pointe position. Because the sides of ribs 4 and 8 are not attached to the sides of rigid members 2, 6, 8 the area of the top layer 40 just above the ribs 2 and 8 act as hinges and allow the entire insole 100 to flex thereby creating the intermediate configurations shown in FIGS. 4 and 5. These intermediate positions allow the ballet dance student to achieve the pointe position in stages rather than all at once. This configuration reduces the chance of foot injury for the begriming ballet dancer, and can even be effective for a seasoned ballet dancer, especially if that dancer is rehabilitating her foot or ankle after an injury.

Figure 6:
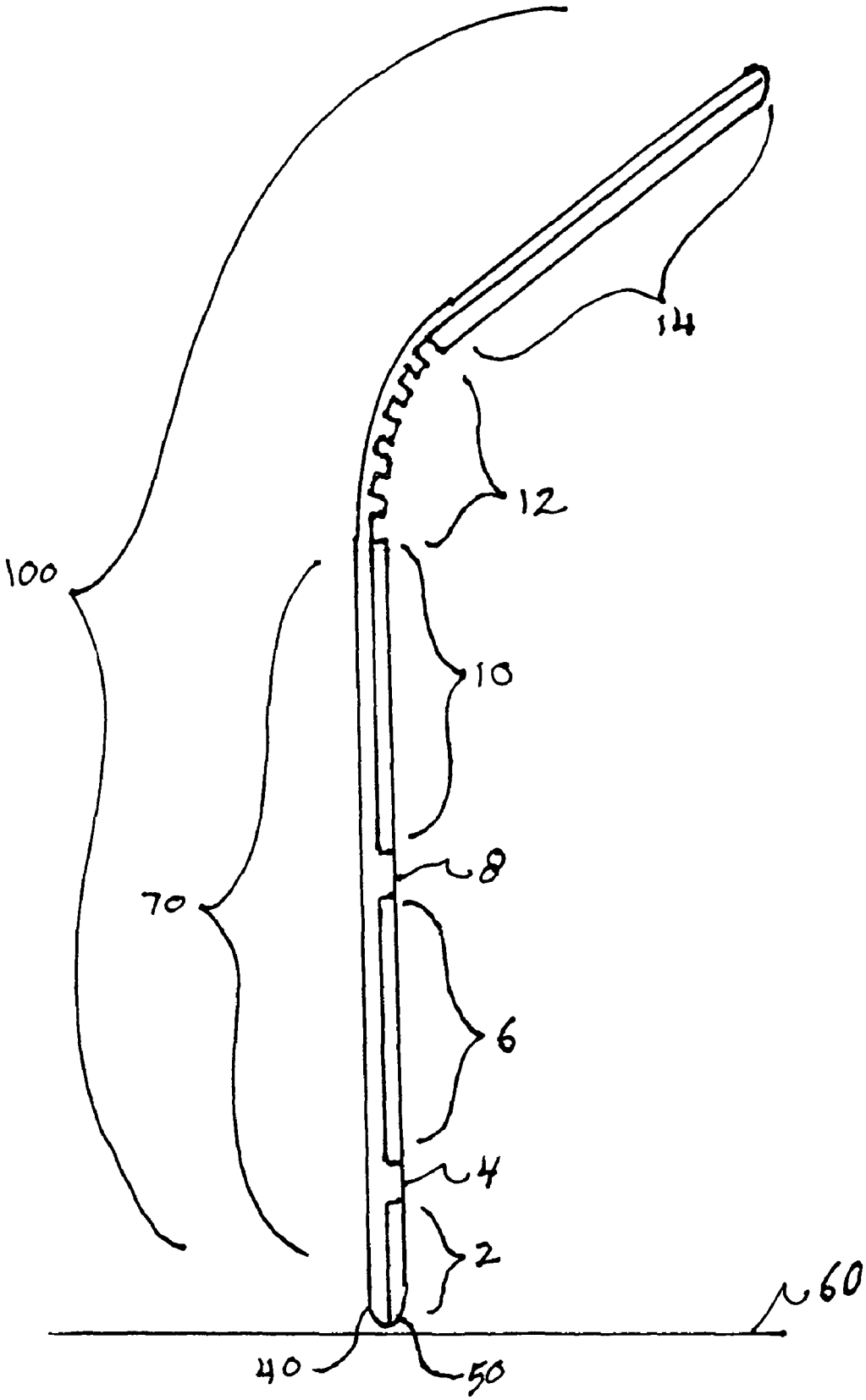
FIG. 6 is a side view of the invention in the pointe position.
Figure 7:
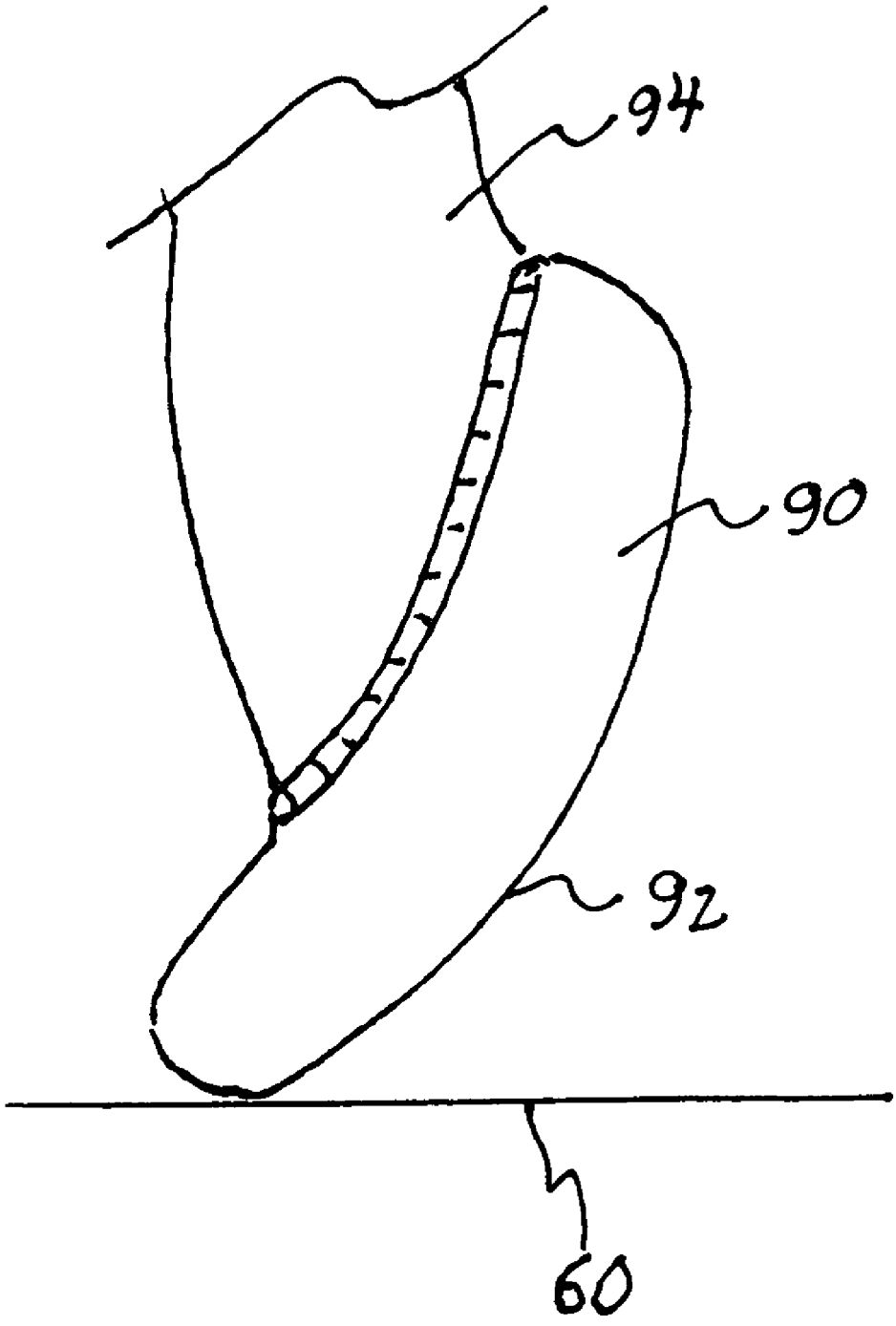
FIG. 7 is a side view of a ballet slipper in an intermediate position.
Figure 8:
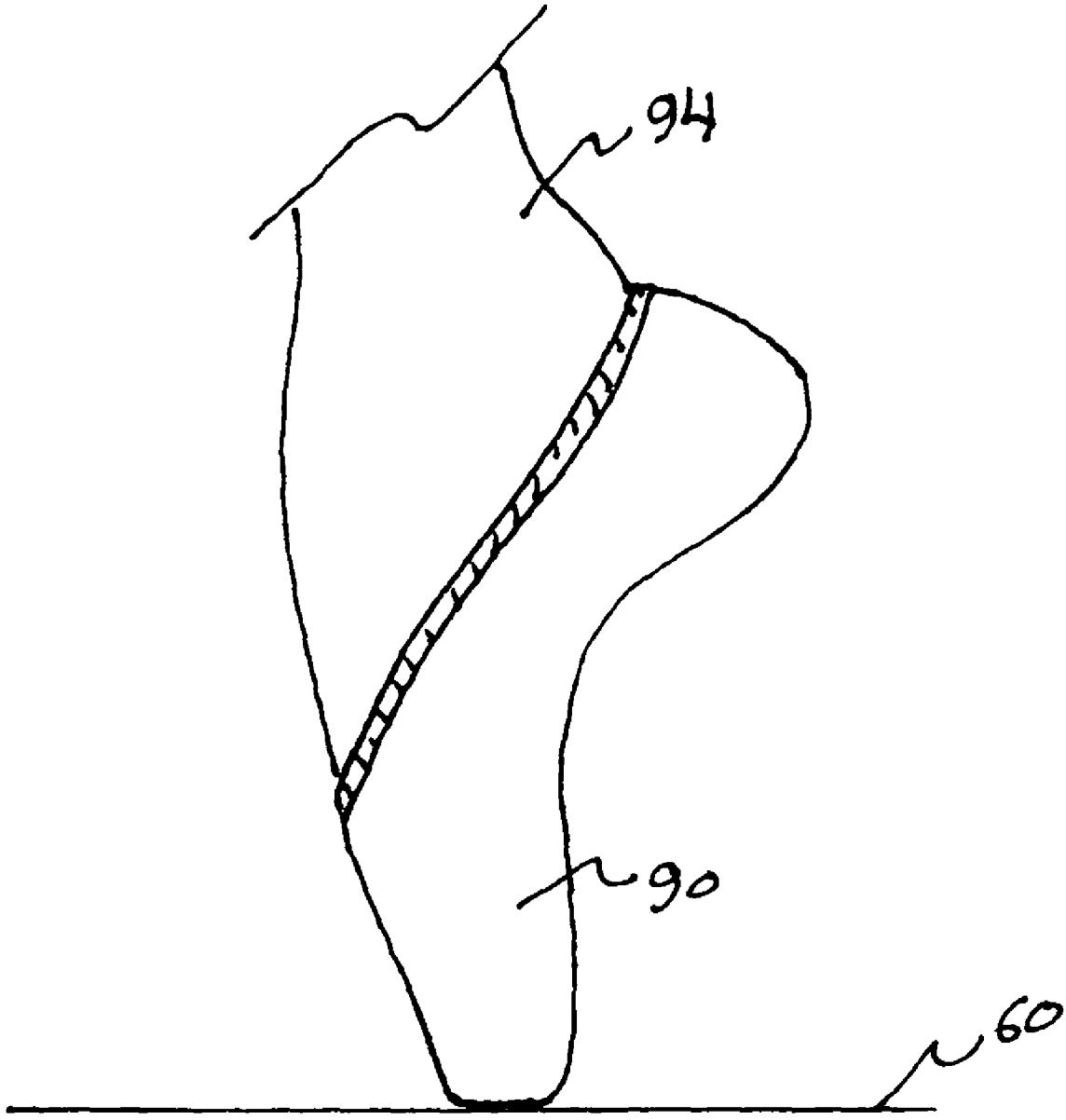
FIG. 8 is a side view of a ballet slipper in the pointe position.

FIG. 6 shows a side view of the insole 100 in the pointe position. This is the position that the ballet dancer is striving for where she is dancing on the tips of her toes. In this position the ribs 4, 8 have completely filled in the space between rigid members 2, 6, 10 so that the lower and middle portion of the insole can remains straight with out bending to the right. It, in effect, duplicates the conditions of a standard insole which is completely rigid 70 at the lower and middle region of the insole. The plurality of ribs 12 provides some laterally stability of the insole while at the same time, allowing the rigid heal portion 14 of the insole to bend to the right thereby facilitating the classic on point position of a ballet dancer's foot 94 and slipper 90 as shown in FIG. 8 FIG. 7 shows a ballet dancer's foot 94 and slipper 90 in an intermediate position while incorporating the insole 100 of the present invention thereby allowing the slipper to flex 92 while in an intermediate position.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A point shoe insole for a ballet slipper comprising:

a two layered co-molded plastic sheet having a perimeter shape that generally matches the plan view of a human foot;

said plastic sheet having a top layer made of semi-rigid plastic;

said plastic sheet having a bottom layer made of four of rigid plastic members;

said first rigid member located at the Distal Phalanges region of the foot;

said second rigid member located at the Middle Phalanges region of the foot;

said third rigid member located at the midfoot region of the foot;

said forth rigid member located at the heal region of the foot;

said top sheet having a plurality of horizontally disposed downwardly facing ribs;

said downwardly facing ribs having a thickness similar to that of the thickness of said bottom layer rigid plastic members;

the first and second said downwardly facing ribs tightly fitting between said first, second and third rigid plastic members of said bottom sheet;

a third plurality of said downwardly facing ribs being closely and evenly spaced from each other and not having said rigid plastic members in between and located between said third rigid portion and said forth rigid portion of said bottom layer;

said first rib located at the middle phalanges portion of the foot;

said second rib located at the proximal phalanges portion of the foot; and said third plurality of ribs located at arch portion of the foot.

2. A pointe shoe insole as claimed in claim 1 wherein said first and second downwardly facing ribs form hinges that allow said first, second and third rigid members to flex in one direction during the progression of movement of a user's foot between flat on the ground plane and on pointe, but does not allow said first, second and third rigid members to flex in the opposite direction when the user's foot is on pointe.

3. A point shoe insole for a ballet slipper as claimed in claim 1 wherein said top semi-irigid flexible layer is molded of a thermoplastic elastomer that has a flex rating of approximately sixty shore and said bottom rigid layer made of ABS plastic.

4. A point shoe insole for a ballet slipper as claimed in claim 1 wherein said top layer thickness is approximately one tenth of an inch and said bottom layer thickness is approximately one tenth of an inch.

5. A point shoe insole for a ballet slipper as claimed in claim 1 wherein the width of said first and second ribs are each approximately two tenths of an inch.

6. An alternate embodiment of said insole for a ballet slipper as claimed in claim 1 wherein said third semi-rigid portion located under said arch area is flat on its top and bottom surfaces and does not include downwardly facing ribs.

7. A point shoe insole for a ballet slipper as claimed in claim 1 wherein said co-molded sheet is economical to manufacture and extremely durable during use.

* * * * *